United States Patent [19]

Carr et al.

[11] 4,124,485

[45] Nov. 7, 1978

[54] SEPARATION OF SOLIDS FROM COAL LIQUIDS WITH AN ADDITIVE BLEND

[75] Inventors: Norman L. Carr, Allison Park; Edgar L. McGinnis, Gibsonia, both of Pa.

[73] Assignee: Gulf Research & Development Company, Pittsburgh, Pa.

[21] Appl. No.: 784,049

[22] Filed: Apr. 4, 1977

[51] Int. Cl.[2] ..... C10G 1/06

[52] U.S. Cl. ..... 208/8; 208/10; 210/54 R

[58] Field of Search ..... 208/8, 10; 210/54; 44/53, 56

[56] References Cited

U.S. PATENT DOCUMENTS

| | | | |
|---|---|---|---|
| 1,573,307 | 2/1926 | Dietz | 44/53 |
| 1,573,308 | 2/1926 | Dietz | 44/53 |
| 1,811,552 | 6/1931 | Mann | 44/56 |
| 1,907,309 | 5/1933 | Van Schaack | 44/56 |
| 2,087,582 | 7/1937 | Schneider | 44/56 |
| 4,029,567 | 6/1977 | Farnand et al. | 208/8 |

*Primary Examiner*—Delbert E. Gantz
*Assistant Examiner*—Joan Thierstein

[57] ABSTRACT

Ash-containing solids are separated from coal liquid by adding a blend comprising alcohol and a light oil fraction to said coal liquid, followed by a solids-liquid separation step.

11 Claims, 1 Drawing Figure

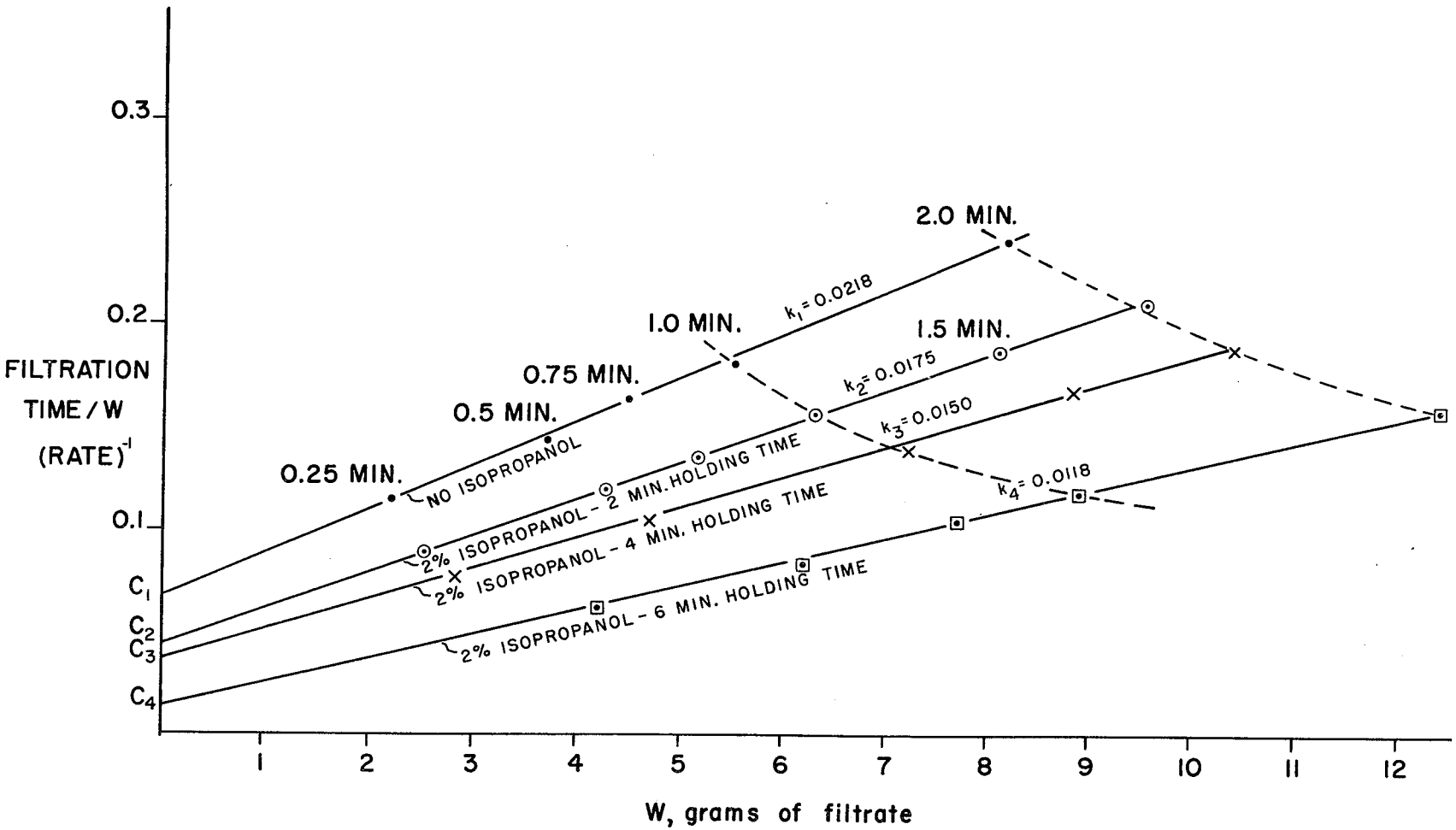
FILTRATION TIME / W (RATE)$^{-1}$
0.3
0.2
0.1
W, grams of filtrate
1
2
3
4
5
6
7
8
9
10
11
12
2.0 MIN.
1.5 MIN.
1.0 MIN.
0.75 MIN.
0.5 MIN.
0.25 MIN.
$k_1$ = 0.0218
$k_2$ = 0.0175
$k_3$ = 0.0150
$k_4$ = 0.0118
NO ISOPROPANOL
2% ISOPROPANOL - 2 MIN. HOLDING TIME
2% ISOPROPANOL - 4 MIN. HOLDING TIME
2% ISOPROPANOL - 6 MIN. HOLDING TIME
$C_1$
$C_2$
$C_3$
$C_4$

SEPARATION OF SOLIDS FROM COAL LIQUIDS WITH AN ADDITIVE BLEND

This inventionn relates to a process for removing ash from coal liquids.

Several solvation processes are now being developed for producing both liquid and solid hydrocarbons from coal. One such process is known as the Solvent Refined Coal (SRC) process. This process is described in a number of patents, including U.S. Pat. No. 3,892,654, which is hereby incorporated by reference. The SRC process is a solvation process for producing deashed solid and liquid hydrocarbonaceous fuel from coal. In this process, crushed raw coal is slurried with a solvent comprising hydroaromatic compounds in contact with hydrogen, or carbon monoxide and water, in a first zone at a high temperature and pressure to dissolve hydrocarbonaceous fuel from coal minerals by transfer of hydrogen from the hydroaromatic solvent compounds to the hydrocarbonaceous material in the coal. The solvent is then treated with hydrogen, or carbon monoxide and water, in a second zone to replenish the hydrogen lost by the solvent in the first zone. The hydrogen-enriched solvent is then recycled. The dissolved liquids contain suspended particles of ash or of ash and undissolved hydrocarbons. The suspended particles are very small, some being of submicron size, and are therefore very difficult to remove from the dissolved coal liquids. Although certain approaches have been tried to agglomerate these particles in order to increase the rate of their separation, none of the present methods for removing solids from liquefied coal has provded to be entirely successful.

It is the purpose of the present, invention to treat the liquid product of a coal solvation process, such as the SRC process, containing suspended or dispersed ash-containing solids with an additive to agglomerate or otherwise affect these solids so that they can be subsequently removed from the coal liquid at a more rapid rate than would otherwise be possible. Any of the known methods for solids-liquid separation can be applied to the treated coal liquids, including filtration, settling, hydrocloning or centrifugation. If settling is employed, coal liquids treated in accordance with this invention will be relieved of their solids content without a subsequent manipulative step. However, because of the rapid rate of solids removal demonstrable by filtration, the present invention is illustrated in the following examples by the filtration method of solids separation.

A composition containing alcohol and coal liquids having suspended or dispersed solid particles comprising ash or ash and undissolved hydrocarbons has been found to be considerably more amenable to solids removal than non-alcoholic coal liquid Primary, secondary or tertiary alcohols are effective. Aliphatic alcohols containing 2 to 10 carbon atoms can be employed. Although longer aliphatic chains may be effective, they are more expensive and needlessly increase the cost of the operation. Particularly effective alcohols include isopropyl and normal, secondary and tertiary butanol. One or more alcohols can be employed. The alcohol can be present in the coal liquid in an amount between 0.05 and 15 weight percent. Alcohol concentration ranges between 0.1 and 10 weight percent or between 0.5 or 1.0 and 6 weight percent are effective.

The alcohol employed in the process does not perform any significant hydrogen donor or coal solvation function. For example, while butanol is a preferred alcohol of this invention, it is not an effective alcohol for purposes of coal solvation. In the present process, the alcohol is added to the coal liquefaction process after completion of the coal dissolving step, i.e. after at least about 85 or 90 weight percent of the coal has been dissolved. There is no need to add alcohol to the process until after the coal dissolving and solvent hydrogenation steps are completed. Furthermore, the alcohol in this process does not result in any significant increase in the hydrogen to carbon ratio of the coal liquid. Thereby, most of the alcohol is not consumed in the present process, nor is there significant conversion to another material, such as a ketone, by hydrogen transfer. To prevent the alcohol from functioning as a hydrogen donor, the coal liquid to which the alcohol is added comprises a significant amount of previously added and different hydrogen donor materials, such as at least 2, 3 or 5 weight percent of hydroaromatic materials, such as tetralin and homologues thereof. The hydroaromatic material present conserves the alcohol so that most of it can be recycled without hydrotreatment. Since the purpose of the alcohol is specific to solids removal, no prior removal of solids from the coal is required and the alcohol can be added to a coal liquid containing generally at least 3 or 4 weight percent of ash. The alcohol does not require any coadditive, such as a base, in order to perform its function, such as would enhance its effect if it were to perform a hydrogen donor function. Also, the alcohol functions in the present invention in the liquid phase and therefore can be used for solids-liquid separation at a temperature below its critical temperature.

The temperature of the coal liquid should be at an elevated level prior to alcohol addition and should be between about 100° and 700° F. (38° and 371° C.), generally, between about 150° and 600° F. (66° and 316° C.), preferably, and between about 400° and 500° F. (204° and 288° C.), most preferably. Following the addition of alcohol the coal mixture should be mixed to form a homogenous composition within the liquid phase. After the addition of the alcohol and before the solids removal step, the coal solution can be allowed to stand at the mixing temperature from 30 seconds to 3 hours, generally, from 1 minute to 1 hour, preferably, or from 2 or 5 minutes to 30 minutes.

It has been discovered in accordance with the present invention that an additional beneficial effect can be achieved when the alcohol additive is in blend with a light oil. The light oil can be a substantially ash-free light coal liquid fraction from which the solids have been removed by filtering or other means, such as a process light oil fraction whose boiling range includes the alcohol. The blend can be recovered from the process as a single fraction, or the light oil and alcohol can be removed separately from the process and then blended in any desired ratio. A blend of an alcohol and a substantially solids-free light coal liquid fraction is itself novel. It is shown below than an alcohol-oil blend imparts a more beneficial effect upon separation of solids from a coal liquid than an alcohol itself. While the advantage incident to the addition of the alcohol by itself declines as the quantity of alcohol added increases beyond a critical value, it has now been discovered than enhanced quantities of alcohol can be employed with advantage by utilizing a blend of alcohol and light oil.

This discovery is economically advantageous since it can avoid the expense of distilling all or part of the alcohol from the process oil prior to recycling. Furthermore, since the alcohol is recycled, there is very little additional operating cost incident to the use of an enhanced quantity of alcohol. It is shown below that phenol, which is present in coal liquids, has a detrimental effect upon solids separation, apparently acting as a dispersion medium. In order to avoid recycle of phenol, the light oil fraction should boil below the boiling point of phenol, which is 358° F. (181° C.). For example, a coal liquid fraction boiling no higher than about 355° F. (169° C.) can be employed. The boiling range of the coal liquid fraction need not overlap the boiling range of recycle process solvent. This upper temperature limitation does not apply if the light oil is not a coal liquid, and therefore does not contain phenols. For example, if the light oil is a petroleum fraction, a light, medium or heavy naphtha boiling no higher than 500° F. (260° C.) can be employed. The amount of alcohol present in the light oil fraction can be between about 1 and 75 weight percent, generally, or between about 10 and 25 weight percent preferably. The amount of solids-free alcohol-light oil blend added to the solids-containing coal liquid can be between about 1 and 50 weight percent, generally, between about 1 and 15 weight percent, preferably, and between about 2 and 5 weight percent, most preferably.

In one mode of performing the present invention, alcohol is added to a hot, unfiltered slurry of dissolved coal and the mixture is stirred and allowed to age. It is then passed through a filter to which a diatomaceous earth precoat had previously been applied. The alcohol-containing filtrate is then fractionated to recover a low boiling fraction containing at least a portion of the alcohol. This fraction is then recycled and mixed with filter feed, together with any make-up alcohol that may be required.

Filtration tests were performed to illustrate the present invention and the data obtained were interpreted according to the following well known filtration mathematical model:

$$(T/W) = kW + C$$

where:

$T$ = filtration time minutes $W$ = weight of filtrate collected in time $T$, grams $k$ = filter cake resistance parameter, minutes/grams$^2$ $C$ = precoat resistance parameter, minutes/gram and, $(T/W) = (\text{rate})^{-1}$ In the filtration tests reported below, the amount of filtrate recovered, W, was automatically recorded as a function of time, T. W and T represent the basic data obtained in the tests. Although the following variables were measured, they were held constant at desired levels in order to obtain comparative measurements: temperature, pressure drop across the filter, precoat nature and method of application, precoat thickness, and the cross-sectional area of the filter.

The W versus T data obtained were manipulated according to the above mathematical model, as illustrated in the FIGURE. The FIGURE is based on Example 8 and shows four curves, each representing a separate filtration. The horizontal axis shows the value for W while the vertical axis shows the value for T/W, which is the reciprocal of the filtration rate. The slope of each curve is $k$, and the intercept of each curve with the vertical axis is C.

In analyzing each curve, the parameter C is primarily a characteristic of the precoat because it is the reciprocal of the filtering rate at the beginning of the test before any significant amount of filter cake has deposited on top of the precoat. On the other hand, the slope $k$ is a parameter of the filter cake which is being deposited upon the precoat during the filtration, and is therefore representative of the filtration itself exclusive of the precoat. A relatively low slope (low value for $k$) represents an advantageously low cake resistance to filtration Stated in another manner, any reduction in $k$ represents an increase in the prevailing rate of filtration. By observing the FIGURE, it is seen that the uppermost curve has the greatest slope (highest $k$) while the lowermost curve has the lowest slope (lowest $k$). The FIGURE shows that after 1 minute of filtering time the upper curve has produced a smaller amount of filtrate than the lower curve. Viewed in another manner, although each curve indicates a lower filtration rate (i.e. higher $(\text{rate})^{-1}$) at the end as compared to the start of a test, a low curve slope indicates that the filtering rate has not diminished greatly during the test.

It is noted that each filtering test is performed without solvent washing of the filter cake. Since a solvent wash is intended to alter the nature of the filter cake, it would also alter the $k$ value. Many industrial filters are of the continuous rotary type wherein filtration cycles of no more than about 1 minute duration are continuously alternated with washing cycles wherein a wash solvent is sprayed through the filter cake to wash off the absorbed coal liquid. Therefore, all the tabulated filtering rates in the tests reported below represent the filtering operation during the first minute of filtration.

In performing the filtration tests of the following examples, a 90 mesh screen located within the filter element was precoated to a depth of 0.5 inch (1.27 cm) with diatomaceous earth. The filter element measure 1.9 cm I.D. by 3.5 cm height and provided a surface area of 2.84 cm$^2$. The screen was supported by a sturdy grid to prevent deformation. The precoat operation was performed by pressuring a 5 weight percent suspension of the dicalite precoat material in process light oil on to the screen using a nitrogen pressure of 40 psi (2.8 Kg/cm$^2$). The precoat operation was performed at a temperature close to that of the subsequent filtering operation. The resulting porous bed of precoat material weighed about 1.2 grams. After the precoat material had been deposited, nitrogen at a pressure of about 5 psi (0.35 Kg/cm$^2$) was blown through the filter for about 1–2 seconds to remove traces of light oil. The light oil flowed to a container disposed on an automatic weighing balance. The light oil was weighed to insure deposition of the required quantity of precoat material. Following this operation the light oil was discarded. The balance was linked to a recorder to be used later to provide a continuous (at 5 second intervals) printed record of filtrate collected as a function of time.

A 750 gram sample of unfiltered oil (UFO) without any additive was then introduced into a separate autoclave vessel which acted as a reservoir. The UFO was maintained at a temperature of 100°–130° F. (38°–54° C.) and was continuously stirred. Stirring was accomplished using two 5 cm turbines. The shaft speed was 2,000 rpm. The filtration was begun by applying a selected 40–80 psi (2.8–5.6 Kg/cm$^2$) nitrogen pressure to the autoclave. The UFO flowing from the autoclave passed through a preheater coil whose residence time was controlled by the manipulation of valves and which was provided with inlet and outlet thermocouples so that the UFO reaching the filter was maintained at a uniform temperature. The UFO leaving the preheater passed to the filter where a solid cake was formed and a filtrate obtained. The filter element and filter heater were also fitted with thermocouples. As indicated above, filtrate was recovered on a balance and its weight was automatically recorded every 5 seconds. The filtrate was collected in a clean container.

Comparative tests to determine the effect of additives were performed using the same feed lot of UFO for which filtration data had been collected. First, the system tubing and the filter were purged of UFO with nitrogen at a pressure of about 100 psi (7 Kg/cm$^2$). The additive substance was pumped into the autoclave reservoir containing UFO. A separate filter element was fitted and precoated in the same manner as described above and the tests employing an additive in the UFO were performed in the same manner as the tests performed on the UFO without an additive. Following each filtration, the residue on the precoat material in the filter was purged with nitrogen and washed with an appropriate liquid to eliminate the UFO and additive combination.

Following is an analysis of a typical unfiltered SRC feed coal liquid employed in the tests of the following examples. Although light oil had been flashed from the oil feed to the filter in process pressure step-down stages and would be available for preparing an alcohol blend, if required, the filter feed oil had not experienced removal of any of its solids content prior to filtration.

Specific gravity, 60° F. (15.6° C.), 1.15

Kinematic viscosity at 210° F. (98.9° C.), 24.1 centistokes

Density at 60° F. (15.6° C.), 1.092

Ash, 4.49 weight percent

Pyridine insolubles, 6.34 weight percent

Distillation, ASTM D1160

| Percent | Temp., ° F. (° C.) at 1 atm. |
|---|---|
| 5 | 518 (270) |
| 10 | 545 (285) |
| 20 | 566 (297) |
| 30 | 602 (317) |
| 40 | 645 (341) |
| 50 | 695 (368) |
| 60 | 768 (409) |
| 70 | 909 (487) |
| 71-recovery of all distillables occurs at 925° F. (496° C.) | |

For tests reported below employing a light oil, following are the specifications for the light oil tested.

Specific gravity, 60° F. (15.6° C.), 0.830

Density at 60° F. (15.6° C.), 0.829

Kinematic viscosity at 100° F. (37.8° C.), 0.8681 centistokes

Distillation, ASTM D—86 at 763 mm Hg

| Percent | Temperature, ° F. (° C.) |
|---|---|
| 5 | 162 ( 72) |
| 95 | 442 (228) |
| EP | 492 (256) |

EXAMPLE 1

A series of filtration tests was performed to illustrate the effect upon filtration of the addition of various alcohols and of phenol to a coal liquid. These tests were performed at a temperature of 500° F. (260° C.) and with a pressure drop across the filter of 40 psi (2.8 Kg/cm$^2$). Following is a tabulation of the results of these tests.

| Additive | k, (min/g$^2$) | C, (min/g) | Rate, (g/min) |
|---|---|---|---|
| None | .0256 | .22 | 3.2 |
| n-propyl alcohol, 2 wgt. % | .0245 | .12 | 4.5 |
| sec. butyl alcohol, 2 wgt. % | .0164 | .13 | 5.0 |
| ter. butyl alcohol 2 wgt. % | .0236 | .05 | 5.6 |
| iso amyl alcohol, 2 wgt. % | .0226 | .28 | 3.1 |
| phenol, 2 wgt. % | .0278 | | |

In considering the above data, it is reiterated that the filtering resistance parameter, *k*, is the best indicator of the effect of the additive upon the filtering operation because this parameter excludes all effects upon filtration inherent in the filtering system and the precoat. On the other hand, the value C is indicative of the effect of the filtering system and the precoat independently of the effect of the alcohol or phenol additives.

The above data show that the filtering resistance parameter, *k*, was reduced to various extents by all the alcohols tested, with secondary butyl alcohol effecting the greatest reduction in the resistance parameter. In contrast, phenol increased the resistance parameter, showing that it is apparently a dispersion medium, rather than an agglomerant. Therefore, the presence of phenol has an adverse effect upon filtration of coal liquids. Since phenol and cresols are present in coal liquids and since phenol boils near 358° F. (181° C.), it is advantageous to the filtration operation to avoid recycling to the filter any process oil fraction including this boiling point. For example, coal liquids boiling no higher than about 350° or 355° F. (177° or 179° C.) can be recycled. Since it is economically imperative to recycle any additive used in order to maintain an additive cost which is lower than the reduction in overall filtering costs achieved by the use of the additive, the additive used is preferably lower boiling than phenol so that a filtrate oil fraction containing the additive but excluding phenol can be inexpensively recovered for recycle to the filter feed stream.

EXAMPLE 2

Additional filtering tests were performed at 410° F. (210° C.) and with a filter pressure drop of 80 psi (5.6 Kg/cm$^2$) to illustrate the effect of methyl alcohol and ethyl alcohol as additives to a coal liquid being filtered. The results of these tests are shown in the following table.

| Additive (2 wgt. %) | k, (min/g$^2$) | C, (min/g) | Rate, (g/min) |
|---|---|---|---|
| None | .0254 | .07 | 5.0 |
| Methyl alcohol | .0341 | .07 | 4.5 |
| None | .0376 | .06 | 4.4 |
| Ethyl alcohol | .0319 | .10 | 4.6 |

As shown in the above data, methyl alcohol has a detrimental effect upon the filtering resistance parameter, *k*, while ethyl alcohol has a slight beneficial effect.

EXAMPLE 3

Tests were performed to determine the effect of organic acids, aldehydes and ketones upon the filtration of coal liquids. The results of these tests are shown in the following table.

| Additive (2 wgt. %) | k, (min/g$^2$) | C, (min/g) | Rate, (g/min) |
|---|---|---|---|
| Filtration at 500° F. (260° C) and a pressure drop of 80 psi (5.6 Kg/cm$^2$) | | | |
| None | .0247 | .20 | 3.5 |
| Butyl aldehyde | .0258 | .18 | 3.5 |
| None | .0263 | .32 | 2.5 |
| Acetic acid | .0245 | .35 | 2.5 |
| None | .0239 | .26 | 3.0 |
| Acetone | .0372 | .23 | 2.9 |
| Filtration at 410° F. (210° C.) and a pressure drop of 80 psi (5.6 Kg/cm$^2$) | | | |
| None | .0235 | .15 | 4.1 |
| Methyl ethyl ketone | .0256 | .17 | 3.9 |

As shown in the above data, butyl aldehyde, methyl ethyl ketone and acetic acid all exhibited an insignificant effect upon the resistance parameter, *k*. Acetone exhibited a slightly detrimental effect. The use of acids would not be desirable in an industrial process because of their corrosive nature.

EXAMPLE 4

Tests were performed to determine the effect of the amount of isopropanol additive upon the filtration of coal liquids. These tests were performed at 500° F. (260° C.) and at a pressure drop of 40 psi (2.8 Kg/cm$^2$). The results of these tests are shown in the following table.

| Additive and concentration, weight percent | k, (min/g$^2$) | Rate, (g/min) |
|---|---|---|
| None | .0192 | 5.6 |
| Isopropanol, 1% | .0119 | 7.3 |
| Isopropanol, 2% | .0065 | 8.6 |
| Isopropanol, 2.7% | .0086 | 9.2 |

The above data show a progressive reduction in the resistance parameter, *k*, as the amount of isopropanol is incrementally increased from 0 to 1 to 2 percent, respectively. However, the advantage at 2.7 percent is lower than that at 2 percent, indicating that an amount of alcohol beyond a critical level decreases the beneficial effect obtainable.

EXAMPLE 5

The tests involving the use of butyl alcohol as an additive were expanded to illustrate the effect of the time of holding the filter feed containing the additive prior to filtration, maintaining a 120° F. (49° C.) holding temperature. The results of these tests are shown in the following table. The filtering tests were performed at 500° F. (260° C.) and 80 psi (5.6 Kg.cm$^2$) and included a holding time of 2 minutes at 500° F. (260° C.).

| Additive and Concentration, Wgt. Percent | k, (min/g$^2$) | C, (min/g) | Rate, (g/min) | Elapsed time at 120° F. (49° C.) between addition of additive and filtration, min. |
|---|---|---|---|---|
| None | .0534 | .06 | 3.8 | — |
| sec.butyl alcohol-2% | .0309 | .29 | 2.8 | 1 |
| sec.butyl alcohol-2% | .0301 | .12 | 4.1 | 40 |
| sec.butyl alcohol-2% | .0309 | .29 | 2.8 | 80 |
| ter.butyl alcohol-2% | .0236 | .05 | 5.6 | 5 |
| ter.butyl alcohol-2% | .0247 | .15 | 4.1 | 45 |

The above data show that the holding time between the introduction of the secondary butyl alcohol to the filter feed and performance of the filtration operation has an effect upon the filtering resistance parameter, *k*. Within 80 minutes of the addition of the 2 percent of secondary butyl alcohol, the effect of the alcohol increased to a peak and then declined, since the observed advantage of the additive is greater after 40 minutes than it is after either 1 or 80 minutes. A similar observation on the effect of time is apparent in the case of tertiary butyl alcohol.

EXAMPLE 6

Tests were performed to illustrate the effect of a blend of a light process oil fraction boiling below 492° F. (256° C.) and isopropanol upon the filtration resistance parameter, *k*. These tests were performed at a temperature of 500° F. (260° C.) and a corrected pressure drop of 40 psi (2.8 Kg/cm$^2$). The results of these tests are shown in the following table.

| Additive and Concentration (weight percent) | k, (min/g$^2$) | Rate, (g/min) |
|---|---|---|
| None | .0464 | 2.4 |
| Isopropanol, 2% | .0210 | 4.1 |
| Light oil, 5% | .0198 | 4.0 |
| Light oil, 5% + isopropanol, 2% | .0182 | 4.1 |
| Light oil, 9.4% | .0046 | 6.3 |
| Light oil, 9.4% + isopropanol, 5.6% | .0011 | 6.4 |

A comparison of the above data with the data of Example 4 shows that an interdependent effect upon filtration resistance is obtained by utilizing a combination of light oil and isopropanol. Example 4 showed that the extent of the improvement obtained when utilizing 2 percent isopropanol was diminished by increasing the amount of isopropanol from 2 to 2.7 percent. However, the data of the present example show that the use of 5.6 percent isopropanol induces a lower filtration resistance than the use of 2 percent of isopropanol, when the isopropanol is combined with a process light oil. Furthermore, the data of this example show that the benefit obtained from the use of 2 percent isopropanol is enhanced when the isopropanol is combined with the light oil. Therefore, the use of a blend of a process light oil fraction and isopropanol not only permits an enhanced effect as compared to the use of isopropanol alone, but also permits the use of progressively greater amounts of isopropanol with progressively improved results. The advantageous combination effect of light oil and isopropanol illustrated by the data of the present example can be economically achieved in practice by recycling a distilled crude light oil fraction of the filtrate whose boiling range includes the boiling point of the alcohol additive, thereby circumventing the expense of separating all or part of the isopropanol from the filtrate oil containing it. This does not preclude the independent recovery of alcohol and light oil and the blending of the two in any desired ratio. It is a considerable advantage of the present invention that an enhanced effect can be achieved via increase of the amount of alcohol employed because, by employing recycle, the increased amount of alcohol has very little effect upon operating costs.

EXAMPLE 7

Several tests were performed using isopropanol to further illustrate the effect of holding time between the addition of the isopropanol to the coal liquid and the filtration of the liquid. The tests were performed at 500° F. (260° C.) and with a pressure drop of 80 psi (5.6 Kg/cm$^2$). The results of these tests are shown in the following table.

| Additive and Concentration, Wgt. Percent | k, (min/g$^2$) | Rate, (g/min) | Elapsed time at 500° F. (260° C.) between addition of additive and filtration, min. |
|---|---|---|---|
| None | .0284 | 3.7 | — |
| Isopropanol, 2% | .0191 | 5.4 | 3 |
| Isopropanol, 2% | .0144 | 7.0 | 6 |
| Isopropanol, 2% | .0139 | 7.1 | 9 |
| None | .0464 | 2.4 | — |
| Isopropanol, 2% | .0209 | 3.4 | 35 |

The above data show an improved effect upon the filtration resistance parameter, *k*, resulting from an extended holding time between the addition of isopropanol and the filtration. These data tend to indicate the occurrence of an interacting process between the alcohol additive and material in the coal liquid.

EXAMPLE 8

Four filtering tests were performed to further illustrate the effect of the time interval between the introduction of isopropanol to the coal liquid and the filtering operation. In one test, isopropanol was not added. The coal liquid of the other three tests contained 2 weight percent isopropanol with holding times of 2, 4 and 6 minutes, respectively. In all of the tests, the temperature was about 500° F. (260° C.) and the pressure drop was 80 psi (5.6 Kg/cm$^2$). The results of these tests are shown in the figure. The times noted at the data points along each parameter curve are the elapsed times between the start of the filtering test and the time at which the data points were obtained. As shown in the figure, the use of isopropanol reduced the filtration resistance in all cases. However, progressively lengthened holding times between addition of the isopropanol and start of the filtration test resulted in progressively lower filtering resistances.

We claim:

1. In a process for removing ash from coal including a dissolving step wherein coal hydrocarbonaceous material is dissolved with a hydroaromatic solvent to produce an effluent stream comprising dissolved coal liquid, hydroaromatics and suspended ash-containing solids, and passing said effluent stream to a solids-liquid separation step, the improvement comprising adding a blend comprising alcohol and a light oil fraction boiling no higher than about 500° F. to said effluent stream in advance of said solids-liquid separation step, said alcohol comprising an aliphatic alcohol containing between 2 and 10 carbon atoms which forms a homogeneous composition within said coal liquid.

2. The process of claim 1 wherein said light oil fraction is a substantially ash-free coal liquid fraction boiling no higher than about 355° F.

3. The process of claim 1 wherein said light oil comprises a petroleum naphtha.

4. The process of claim 1 wherein the amount of said blend comprises between 1 to 50 weight percent of said ash-containing coal liquid.

5. The process of claim 1 wherein said blend comprises between about 1 and 75 weight percent alcohol.

6. The process of claim 1 wherein said blend comprises between about 10 and 25 weight percent alcohol.

7. The process of claim 1 wherein said alcohol comprises isopropanol or normal, secondary or tertiary butanol.

8. The process of claim 1 wherein said dissolving step is performed in the presence of hydrogen and/or carbon monoxide, said effluent stream containing said blend is held from 30 seconds to 3 hours before separation step, and said effluent stream contains at least 3 weight percent ash and at least 2 weight percent of hydroaromatics.

9. The process of claim 1 wherein said blend is added to said effluent stream while the temperature of the effluent stream is between about 100° and 700° F.

10. The process of claim 1 wherein said separation step is a filtration step.

11. The process of claim 1 wherein said blend is a recycle stream of said process.

* * * * *